US009558722B2

(12) United States Patent
Oliver

(10) Patent No.: US 9,558,722 B2
(45) Date of Patent: Jan. 31, 2017

(54) NON-GEARED LINEAR TUNING HARDWARE FOR ACOUSTIC GUITARS AND RELATED METHODS

(71) Applicant: Traveler Guitar, Inc., La Jolla, CA (US)

(72) Inventor: J. Corey Oliver, Redlands, CA (US)

( * ) Notice: Subject to any disclaimer, the term of this patent is extended or adjusted under 35 U.S.C. 154(b) by 0 days.

(21) Appl. No.: 14/479,037

(22) Filed: Sep. 5, 2014

(65) Prior Publication Data

US 2015/0068385 A1 Mar. 12, 2015

Related U.S. Application Data

(60) Provisional application No. 61/874,895, filed on Sep. 6, 2013.

(51) Int. Cl.
*G10D 3/14* (2006.01)
*G10D 1/08* (2006.01)

(52) U.S. Cl.
CPC *G10D 3/14* (2013.01); *G10D 1/08* (2013.01); *Y10T 29/49574* (2015.01)

(58) Field of Classification Search
CPC ..... G10D 3/12; G10D 3/04; G10D 3/14; G10D 3/143; G10D 3/10; G10D 1/08
USPC ..... 84/298–302, 297 R
See application file for complete search history.

(56) References Cited

U.S. PATENT DOCUMENTS 5,410,936 A * 5/1995 Ellsworth ..... G10D 3/04 84/267
5,717,150 A * 2/1998 Rose ..... G10D 3/14 84/297 R

* cited by examiner

*Primary Examiner* — Kimberly Lockett
(74) *Attorney, Agent, or Firm* — Buche & Associates, P.C.; John K. Buche; Bryce A. Johnson

(57) ABSTRACT

A non-geared linear tuning and anchoring system for strings of a stringed musical instrument employing plug-ended strings inserted into the shaft of a string retainer and tensioned by retracting the slidable string retainer within a channel aligned with the strings.

7 Claims, 4 Drawing Sheets

NON-GEARED LINEAR TUNING HARDWARE FOR ACOUSTIC GUITARS AND RELATED METHODS

CROSS-REFERENCE TO RELATED APPLICATIONS

This application claims the priority and benefit of U.S. Prov. Pat. App. Ser. No. 61/874,895 (filed Sep. 6, 2013) entitled "Non-geared linear tuning hardware for acoustic guitars and related methods." Said provisional application is hereby incorporated by reference in its entirety.

STATEMENT REGARDING FEDERALLY SPONSORED RESEARCH OR DEVELOPMENT

Not applicable.

BACKGROUND OF THE INVENTION

Field of Invention

The subject matter of this disclosure relates to tuning control systems and string anchoring mechanisms for stringed musical instruments. More particularly, the subject matter of this disclosure relates to gearless tuners for easy string installation and tuning of stringed musical instruments.

Description of Related Art

Musical instruments produce sounds. Sound is typically a mechanical wave traveling through a compressible medium at a frequency within the range of human hearing. A hearing-frequency vibrating wave may be produced in air via vibrating a surface. Accordingly, musical instruments have employed vibrating surfaces as a means for producing sound.

Stringed musical instruments produce sound via vibrating the surface of tautly suspended and plucked strings. The quality of the sound produced by a vibrating string depends on the tautness of the string. As a result, strings are usually tautly suspended over a stringed instrument by fixedly mounting a first end of the string to the instrument and adjustably mounting the other end to the instrument so that the tautness and corresponding sound quality of the string may be adjusted. In other words, strings of a string instrument are tuned by tautening or slacking the string via manipulating the adjustable end.

Many systems exist for adjusting the tautness (i.e., tuning) of strings in a stringed instrument. A well-known system involves fixedly securing one end of a string to an anchor while adjustably attaching the other end to a winding mechanism. Usually, the winding mechanism is a peg wherein the peg is rotated to wind the string until the desired tension is imparted across the string against the anchor.

Winding mechanisms, such as a rotatable peg, utilize gear arrangements. Tuning systems with winding means can become less accurate as the gears wear down with use. Additionally, attaching the string to these types of tuning mechanisms can sometimes be tedious and difficult.

In view of the foregoing, gearless tuners have been developed. For example, U.S. Pat. No. 5.277,095 to Steinberger discloses a tuner for stringed musical instruments wherein one end of a string is anchored to the neck of the instrument while the other end is attached to the tip of a screw that is positioned into a stationary nut receptacle on the soundboard, which soundboard amplifies the vibration of a plucked string. In Steinberger's tuner, unscrewing the screw tautens the string to the proper tension. One disadvantage associated with this gearless tuning mechanism is that the sound produced by the guitar is inhibited due to dampening of the soundboard vibrations via the string being mechanically secured to the soundboard.

SUMMARY OF THE DISCLOSED EMBODIMENT

In view of the foregoing disadvantages inherent in the known types of string tuning and anchoring systems, the present invention provides a tuning and anchoring system which does not rely on gears. Another object of this present invention is to provide a tuning and anchoring system that does not inhibit the acoustic properties of the stringed instrument. Further, an additional advantage of the present invention is that it eliminates the need for a headstock as is traditionally required on acoustic stringed instruments. Yet another advantage of the present invention is to provide a string anchoring mechanism and attachment method which maximizes sustain.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures in which.

it is to be noted, however, that the appended figures illustrate only a typical embodiment of the disclosed apparatus and are therefore not to be considered limiting of its scope, for the disclosed apparatus may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Generally, the disclosed subject matter is a tuning system for securing strings to the body of a stringed musical instrument. In one embodiment, the tuning system features a tuning block mounted to the instrument and a plurality of strings. Suitably, each string comprises a ball that is fixed to one end thereof and means for securing the other end of the string to the instrument. In a preferred embodiment, the ends of the strings without a ball may be anchored via a clamp or otherwise secured to the instrument at the end of the instrument's neck so that a traditional headstock is not needed. A tuning block may preferably be mounted on the instrument adjacent to the ball end of the strings. Suitably, the tuning block features a string retainer for each string, wherein one end of each string retainer is defined by an opening for slidable insertion of the ball. The opening extends the length of the string retainer to permit the string to protrude unobstructed through the open end of the string retainer. The tuning system also includes means for controllably adjusting the longitudinal position of each string retainer in relation to the side walls of the tuning block. The adjusting means individually increases or decreases the tension in the corresponding string of the instrument by applying a tensile force against the means for securing the string to the instrument.

Figure 1:
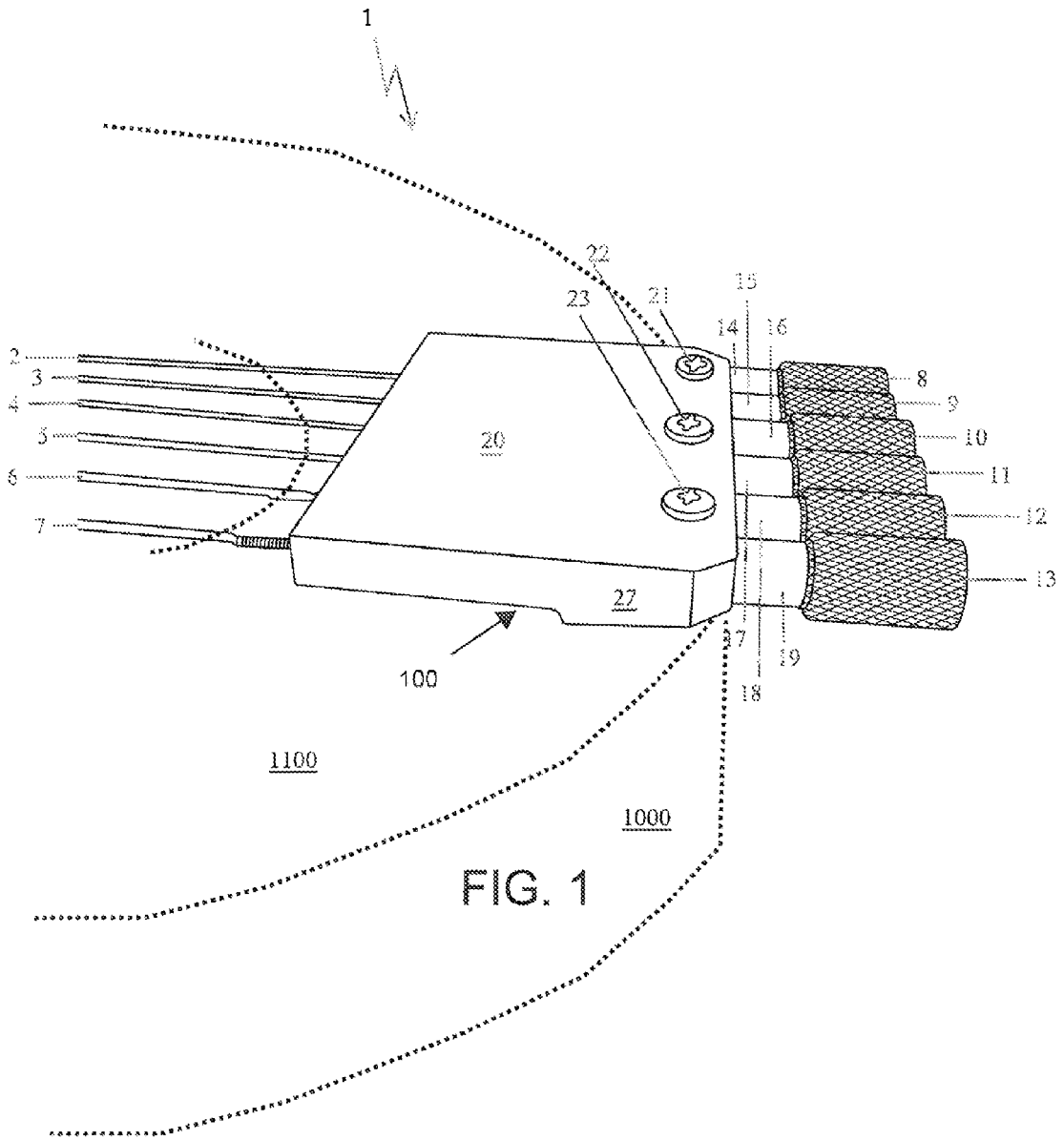
FIG. 1 depicts a perspective view of the tuning and anchoring system.

FIG. 1 is an perspective view of a preferred embodiment of a tuning system 1 for a six stringed musical instrument 1000. As shown the tuning system features: a cover 20; six string tuners 14, 15, 16, 17, 18, and 19 with knobs 8, 9, 10, 11, 12, and 13; an anchor block 27; and attachment screws 21, 22, and 23 for removably securing (a) the cover 20 to the anchor block 27 and (b) the anchor block 27 to the soundboard 1100 of the instrument 1000. in the embodiment shown by FIG. 1, the knobs 8, 9, 10, 11, 12, and 13 have annular grooves to facilitate grasping the knobs 8, 9, 10, 11, 12, and 13 for rotation. In other embodiments, knobs 8, 9, 10, 11, 12, and 13 may alternatively include a hexagonal bore for rotation by a hex key or may include a slot for rotation by a screwdriver. Suitably, the anchor block 27 is configured with a raised surface to minimize contact with the soundboard 1100 of the instrument 1000 when installed. This raised surface facilitates string sustain and produces a louder tone because the soundboard 1100 is not inhibited by the anchor block 27. In one embodiment, said configuration is defined by a gap 100 between the tuning system 1 and the soundboard 1100. The gap 100 is discussed further below in connection with FIG. 3.

Figure 2:
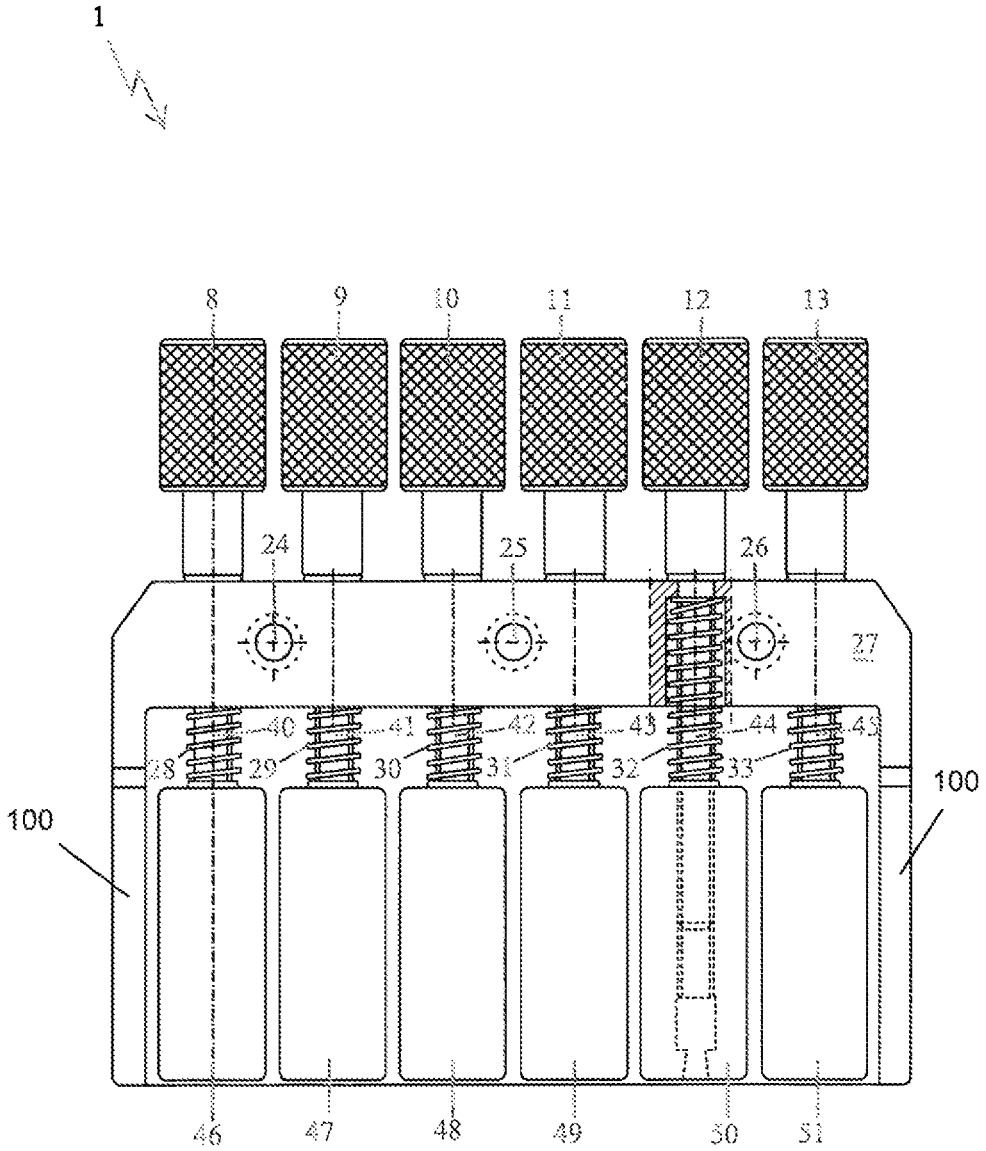
FIG. 2 depicts the bottom plan view of the tuning and anchoring system.
Figure 5:
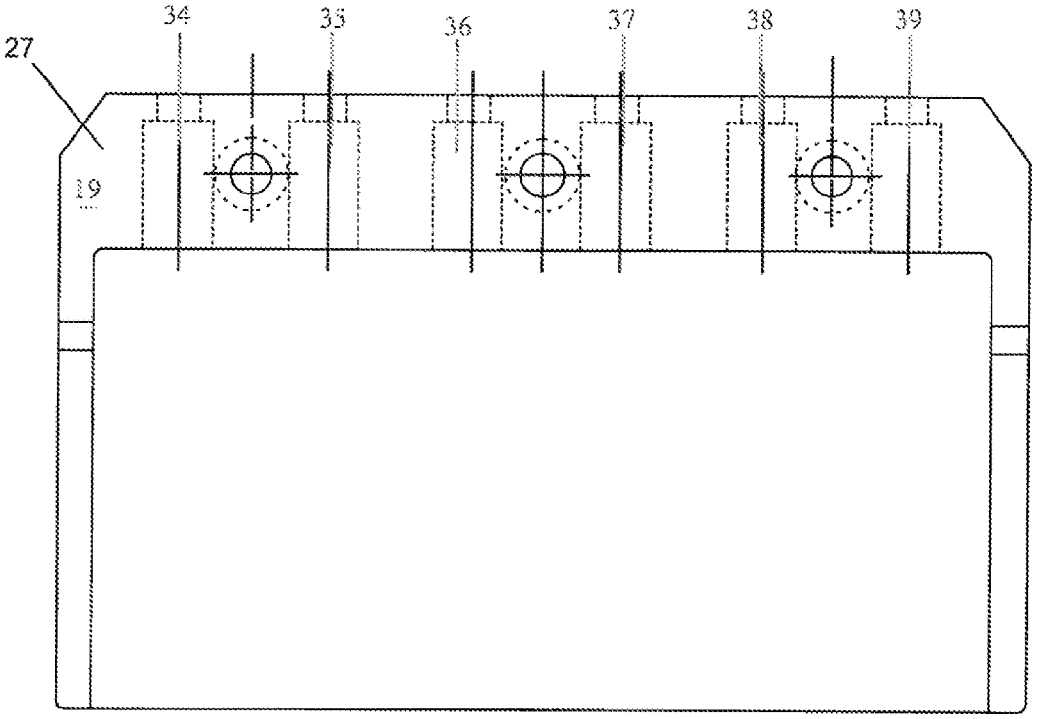
FIG. 5 depicts a bottom view of the tuning and anchoring system.

FIG. 2 shows a bottom view of tuning system 1 to expose the anchor block 27 and string retainers 46, 47, 48, 49, 50 and 51. FIG. 5 shows the anchor block 27 with the string tuners and string retainers 46, 47, 48, 49, 50 and 51 removed. In FIGS. 1, 2 and 5, bores 24, 25, and 26 extend the depth of anchor block 27 to, in operation, receive the attachment screws 21, 22, and 23 (FIG. 1) for removably securing the cover 20 (FIG. 1) to the anchor block 27. In one mode of operation, the anchor block 27 removably attaches to the instrument 1000 (FIG. 1) by rotating screws 21, 22, and 23 (FIG. 1) which are received, respectively, by bores 24, 25, and 26, into the soundboard 1100 (FIG. 1).

Figure 3:
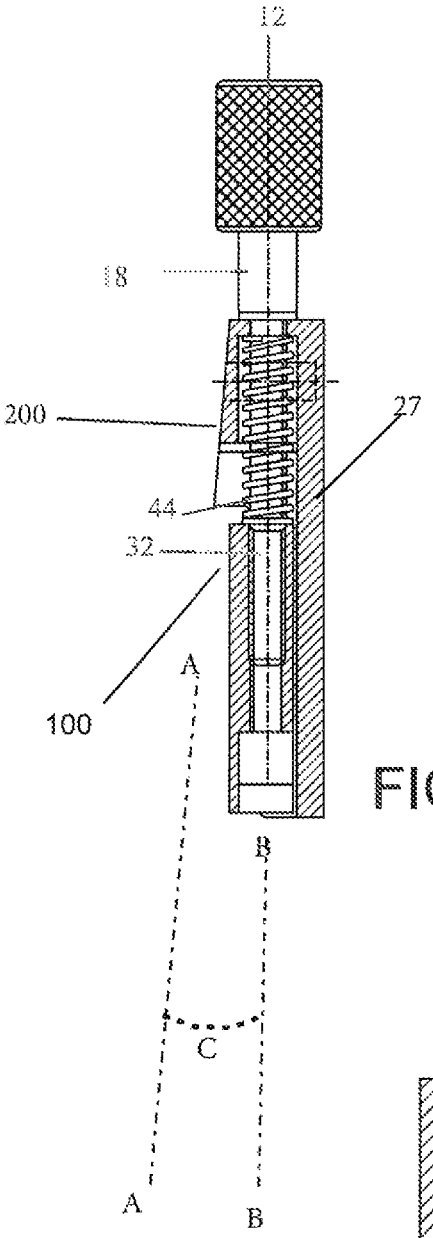
FIG. 3 depicts a side cross-sectional view of the tuning and anchoring system.

FIG. 3 is a cross section of the anchor block 27 to illustrate a string tuner 18. FIGS. 2, 3, and 5 illustrate the relationship of the string tuners 14, 15, 16, 17, 18, and 19 and the anchor block 27. Suitably, the string tuners 14, 15, 16, 17, 18, and 19 feature cylindrical shafts of a first diameter at one end and a reduced second diameter at the other end. In one embodiment, the knobs 8, 9, 10, 11, 12, and 13 are affixed to the first diameter. In the same embodiment, a portion of the string tuners 14, 15, 16, 17, 18, and 19 of the reduced second diameter extend, respectively, through bores 34, 35, 36, 37, 38, and 39 (FIG. 5) in the rearward wall of the anchor block 27. It should be noted that the foot 200 of the anchor block 27 features a plane (A-A) that is not parallel with the median plane (B-B) of the anchor block 27 so that the gap 100 is created when the anchor block 27 is installed on an instrument (see FIG. 1). In other words, the plane (A-A) of the foot 200 and the median plane (B-B) of the housing of the anchor block 27 form an oblique angle C relative to one another.

FIG. 5 shows a bore 34 through the outer wall of the anchor block 27. Referring to FIGS. 2 through 5, the bores 34, 35, 36, 37, 38, and 39 are of a first diameter near the outer edge and a larger second diameter inside the anchor block 27. The diameter of the knobs 8, 9, 10, 11, 12, and 13 may suitably be greater than the first diameter of the bores in the outside wall of the anchor block 27 to prevent the knobs 7, 8, 9, 10, and 11 from passing through the rearward wall of anchor block 27. The second diameter of the bores 34, 35, 36, 37, and 38 (FIG. 5) may preferably be greater than diameter of the shaft of string tuners 19, 20, 21, 22, and 23 (FIG. 2) so that springs 29, 30, 31, 32, and 33, which are of a diameter greater than diameter of the shaft of string tuners 19, 20, 21, 22, and 23 but less than diameter of bores 34, 35, 36, 37, and 38, may be deposited in the bores around the shafts. In other words, the springs 29, 30, 31, 32, and 33 may suitably mount onto the shaft of string tuners 19, 20, 21, 22, and 23 and be deposited to within the bores of the anchor block 27. The first diameter portion of the bores 34, 35, 36, 37, and 38 in the outer wall of the anchor block 27 may suitably the prevent springs 28,29, 30, 31, 32, and 33 from passing through the rearward wall of the anchor block 27.

Figure 4:
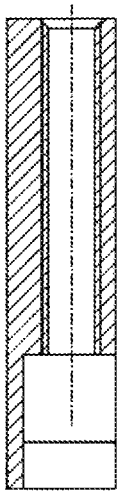
FIG. 4 depicts a cross-sectional view of the tuning retainer.

Referring back to FIGS. 2 and 3, the tuning system 1 further comprises String retainers 46, 47, 48, 49, 50 and 51, that a are generally cylindrical in shape with axially aligned longitudinal bores. FIG. 4 is a cross-section of the string retainer. In operation, an instrument string with a ball end is slidably inserted into a tapered bore from the first portion and passes through the second portion (see FIG. 2, element 50). The diameter of the bore in the first portion is larger than the diameter of the ball end. The diameter of the bore in the second portion is smaller than the diameter of the ball end to prevent the ball from passing through the second portion of the string retainer 50. After a string with a ball end is retained by the string retainer, it is threadably mounted onto the shaft of string tuners 19, 20, 21, 22, and 23.

Referring to FIGS. 1 and 2, the strings 2, 3, 4, 5, and 6 can be tuned by adjusting the tension therein by rotating the knobs 7, 8, 9, 10, and 11. In one mode of operation, turning of the knobs may be accomplished by grasping the outer surface of knobs 7, 8, 9, 10, and 11 between two fingers and twisting the same. Preferably, the tension of the spring keeps the string tuner and string retainer frictionally engaged. Thus, turning knobs 7, 8, 9, 10, and 11 causes the string retainer to be moved axially either rearward or forward relative to the anchor block 27. In the preferred mode of operation, the anchor block 27 is secured to the instrument so that the anchor block 27 does not rotate while a string is tuned. Further, the tension in strings 2, 3, 4, 5, and 6 may suitably pull forward on the string retainer and string tuner so that the tuning knob may bear against the rear wail of the anchor block 27.

Other features will be understood with reference to the drawings. While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

Applicant hereby incorporates each of the claims that were originally filed with the specification as if fully set forth herein.

I claim:

1. A tuning system for securing strings to the body of a stringed musical instrument, said system comprising:

at least one string;

a tuning block that is mounted on the instrument so that a gap exists between a forward portion of the tuning block and a soundboard of the instrument;

a string tuner that is provided therethrough a back portion of the tuning block and received by a retainer so that rotation of the string tuner relative to the tuning block moves the retainer (a) above the gap and within the tuning block and (b) forward or backward relative to the tuning block;

wherein a first end of the string is affixed to the instrument and a second end of the string is affixed to the retainer whereby moving the retainer relative to the tuning block tautens or slackens the string; and, wherein the string tuner is threaded into the retainer.

2. A tuning system for securing strings to the body of a stringed musical instrument, said system comprising:

at least one string;

a tuning block that is mounted on the instrument so that a gap exists between a forward portion of the tuning block and a soundboard of the instrument;

a string tuner that is provided therethrough a back portion of the tuning block and received by a retainer so that rotation of the string tuner relative to the tuning block moves the retainer (a) above the gap and within the tuning block and (b) forward or backward relative to the tuning block;

wherein a first end of the string is affixed to the instrument and a second end of the string is affixed to the retainer whereby moving the retainer relative to the tuning block tautens or slackens the string; and, wherein the tuning block features a foot with a plane that is not parallel with the median plane of the tuning block whereby the gap exists.

3. A method of fabricating a stringed instrument comprising the steps of:

Constructing an instrument with a neck and a soundboard;

Securing an anchor block of a tuning system to the soundboard, wherein the anchor block is defined by a housing and a foot, wherein the foot is defined by a plane that is not parallel with the median plane of the housing whereby a gap exists between the housing and the soundboard whenever the anchor block is installed on the stringed musical instrument, wherein the plane of the foot and the median plane of the housing meet at an oblique angle.

4. The method of claim 3 wherein the neck does not feature a headstock.

5. The method of claim 3 further comprising the steps of:

Installing a string retainer within the housing so that the string retainer s movable relative to the housing and over the gap.

6. The method of claim 5 further comprising the steps of:

Securing a first end of a string to the neck; and

Securing a second end of the string to the string retainer whereby moving the string retainer tautens or slackens the string.

7. The method of claim 6 where the plane of the foot and the median plane of the housing meet at an oblique angle.

* * * * *